US006560891B1

(12) United States Patent
Arnold

(10) Patent No.: US 6,560,891 B1
(45) Date of Patent: May 13, 2003

(54) PUNCH TOOL ALIGNMENT DEVICE

(75) Inventor: Robert Arnold, Spokane, WA (US)

(73) Assignee: EK Success, Ltd., NJ (US)

( * ) Notice: Subject to any disclaimer, the term of this patent is extended or adjusted under 35 U.S.C. 154(b) by 0 days.

(21) Appl. No.: 09/989,300

(22) Filed: Nov. 21, 2001

(51) Int. Cl.[7] ..... B25H 7/00
(52) U.S. Cl. ..... 33/670; 33/564
(58) Field of Search ..... 33/670, 562, 563, 33/564; 72/324; D19/72

(56) References Cited

U.S. PATENT DOCUMENTS 2,077,232 A * 4/1937 Grahek ..... D19/72
3,176,570 A * 4/1965 Gaya ..... D19/72
3,987,695 A * 10/1976 Neilsen ..... D19/72
D361,786 S * 8/1995 Yang ..... D19/72
D397,359 S * 8/1998 Bedol et al. ..... D19/72
6,216,354 B1 * 4/2001 Carbone ..... 33/565
6,321,457 B1 * 11/2001 Lariviere et al. ..... 33/562

* cited by examiner

*Primary Examiner*—Christopher W. Fulton
*Assistant Examiner*—Yaritza Guadalupe
(74) *Attorney, Agent, or Firm*—Sofer & Haroun, LLP

(57) ABSTRACT

The present invention is directed to an alignment device for perforating a sheet media with a punch comprised of a base member having a punch receiving area, an indicia receiving area, a sheet media receiving area and a longitudinal guide edge for aligning the sheet media. A template is provided which has a plurality of alignment indicia where the template is insertable in the indicia area of the base portion, so that when the sheet media is placed along the longitudinal guide edge and aligned with the first of the alignment indicia, the punch is aligned to punch a first hole. The sheet media is then moved to the second spaced indicia, such that the punch is aligned to punch a second hole.

17 Claims, 10 Drawing Sheets

PUNCH TOOL ALIGNMENT DEVICE

FIELD OF THE INVENTION

This invention relates to an alignment device. More specifically, this invention relates to an alignment device for use with punching decorative or functional patterns along the edge of a sheet media with a punch tool.

BACKGROUND OF THE INVENTION

This invention relates to the use of manually operated punch tools such as those commonly referred to as "craft punches" to produce decorative or function holes or edge shapes in and along the edges and on the comers of sheet media such as paper or card stock. These punches typically comprise a metal die with a spring loaded metal punch and housing, typically fabricated with plastic.

In the prior art it is necessary for the user to visually position the proximity of the punch to the edge and its spacing along the edge of the sheet material. This has been done with or without the assistance of such aides as lines drawn on the surface of the sheet materials to guide the positioning and spacing of the punch holes. Even when the media is carefully aligned, misjudging the material position or movement while punching often occurs resulting in poorly aligned holes or edge shapes.

In addition to the difficulty with aligning the punch tool on the sheet media it is sometimes desirable to place a series of punches or even scoring, embossing or coloring devices along the border edges and comers of a sheet media in order to make a border design. Standard punch tools or devices, when used for this purpose, are not only difficult to align properly but are also inaccurate at achieving proper and even spacing between punched designs.

As such, it is the aim of the present invention to overcome these difficulties and provide a means for accurately aligning the media to be punched, scored, embossed or colored within the slot of the punch or device so as to produce accurately aligned and evenly spaced corner or edge punches.

SUMMARY OF THE INVENTION

The present invention is directed to an alignment device for perforating a sheet media with a punch comprised of a base member having a punch receiving area, an indicia receiving area, a sheet media receiving area and a longitudinal guide edge for aligning the sheet media.

A template is provided having a plurality of equally or unequally spaced alignment indicia as required by the design being applied to the sheet material, where the template is insertable in the indicia area of the base portion, so that when the sheet media is placed along the longitudinal guide edge and aligned with the first of the alignment indicia, the punch is aligned to punch a first hole then the sheet material is moved to the second alignment indicia, and the punch is aligned to punch a second hole, continuing until the border pattern is complete. In some cases more than one punch may be combined in a border pattern in which case alignment indicia for each punch will be included on the template.

DETAILED DESCRIPTION

Figure 1:
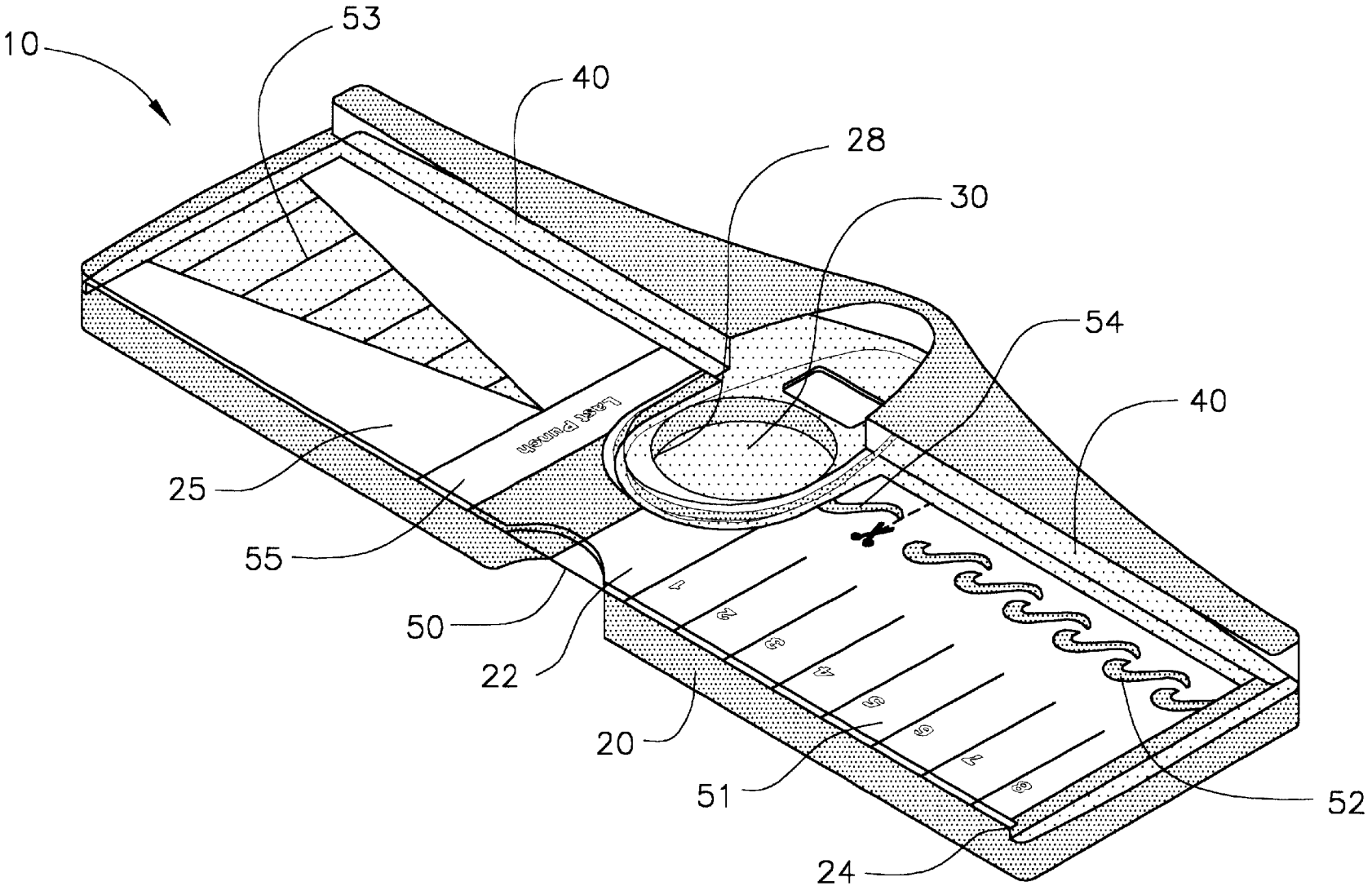
FIG. 1 illustrates an angled elevation of an alignment device, in accordance with one embodiment of the present invention.
Figure 4:
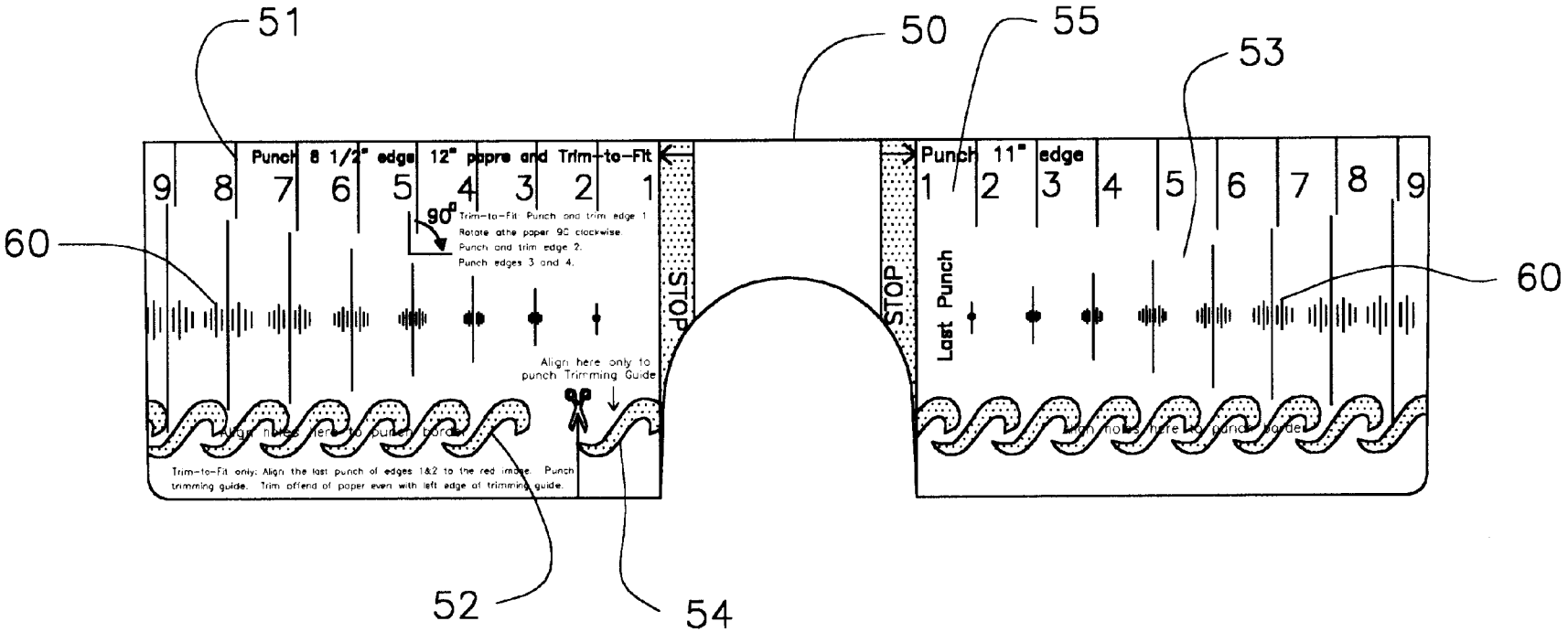
FIG. 4 illustrates a top view of a removed template for an alignment device, in accordance with one embodiment of the present invention.

In one embodiment of the present invention, as illustrated in FIGS. 1 and 4, an alignment device 10 is configured to provide a means for accurately aligning a sheet media 14 within a punch tool 12 so as to facilitate the use of punch tool 12 in punching a border design 16 into sheet media 14.

To this end, as illustrated in FIG. 1, a base 20 is provided having a template receiving area comprised of a transparent top piece 22 and a template slot 24. Transparent top piece 22 can be constructed of any form of transparent polymer such as Lexan®, however any such transparent polymer capable of providing a stable punch surface is within the contemplation of the present invention. Template slot 24 is disposed just below transparent top piece 22 and just above the top of base 20. The surface of transparent top piece 22 provides alignment device 10 with a sheet media receiving area 25 configured to provide a stable area to support sheet media 14 for punching, embossing, scoring or coloring depending on what device the user inserts into a punch receiving area 28.

In one embodiment of the present invention, as illustrated in FIG. 1, alignment device 10 maintains a longitudinal guide edge 40 disposed perpendicular to sheet media receiving area 25 along the length of base 20. Guide edge 40 is configured to support the edge of sheet media 14 when punching border design 16.

In one embodiment of the present invention, as illustrated in FIG. 1, alignment device 10, maintains a punch receiving area 28 having a punch cut out 30 to capture the pieces of sheet media 14 cut out by punch 12. Punch receiving area 28 is disposed in base 20 and protrudes into sheet media receiving area 25. Transparent top piece 22 is preferably molded with a cut out area such that it does not contact punch receiving area 28. It should be understood that although punch tool 12 is shown and described, any such device such as an embosser, a scorer or a device that outlines an image to be colored is contemplated by the invention, the invention not being limited in this respect.

Figure 2:
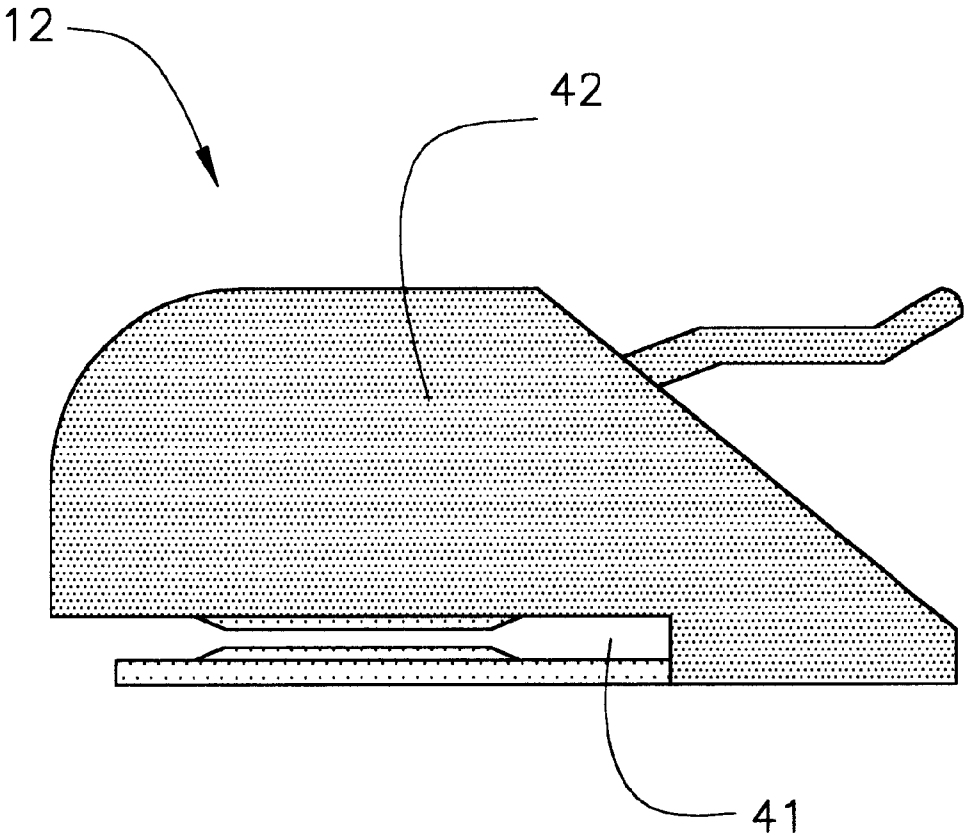
FIG. 2 illustrates a side elevation of punch tool, in accordance with one embodiment of the present invention.

As illustrated in FIG. 2, punch tools 12 are comprised of a body 42 and a sheet media slot 41. Punch receiving area 28 is a cut out in base 20 of such a depth that the upper surface of the base of punch tool 12 is substantially co-planar with sheet media receiving area 25. When sheet media 14 is placed on sheet media receiving area 25 it can be easily inserted into sheet media slot 41 of punch tool 12.

Figure 5:
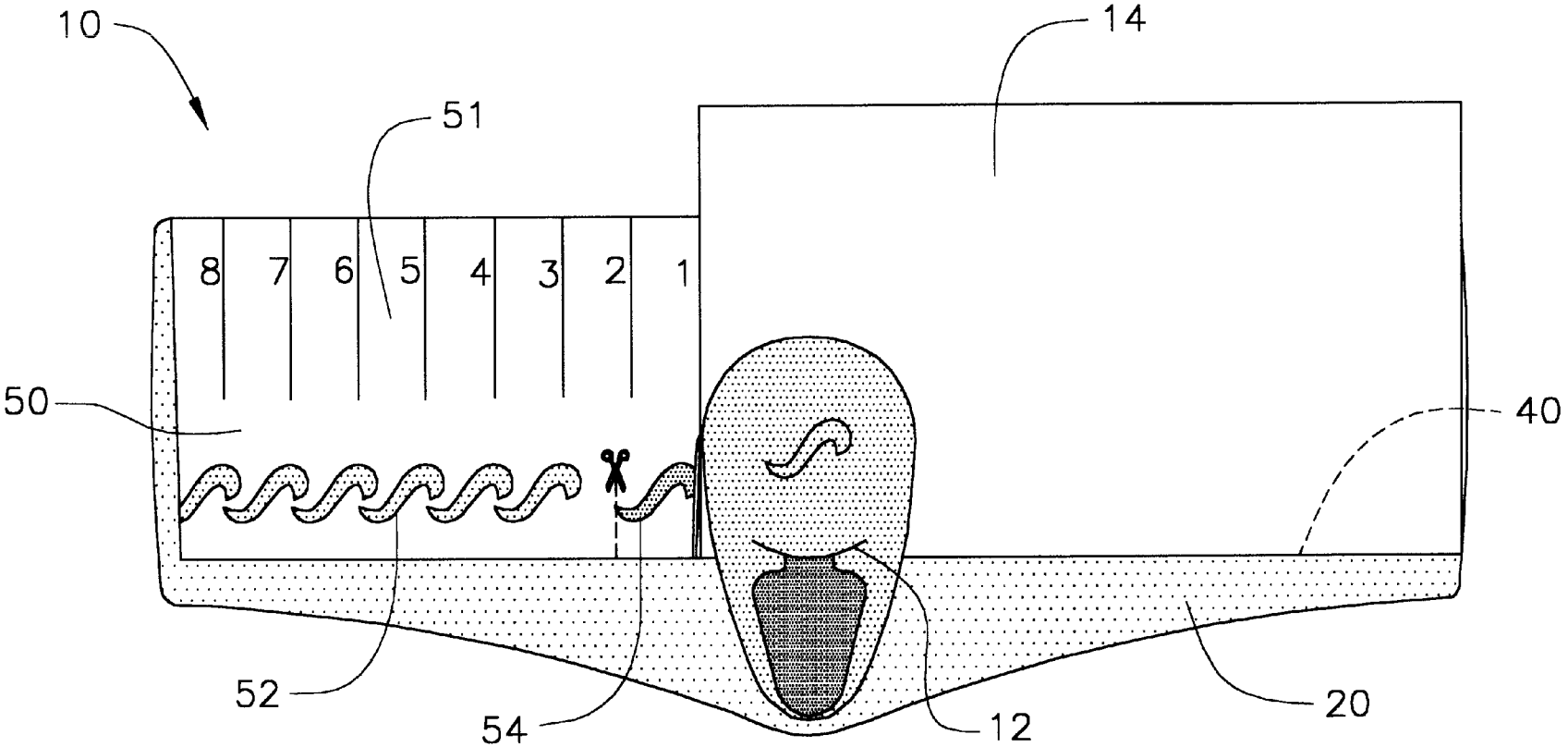
FIG. 5 illustrates a top view of an alignment device, a punch tool and a sheet media, in accordance with one embodiment of the present invention.

In one embodiment of the present invention, as illustrated in FIG. 4, a template 50 is provided, configured to be inserted into template slot 24 of alignment device 10. Template 50 is preferably constructed of sturdy cardboard or plastic however, any material that is sufficiently thin to fit within template slot 24 is within the contemplation of the present invention. Each template 50 is configured to be used to produce a particular border pattern 16 such that when sheet media 14 edges and punched holes are aligned to the various alignment indicia on template 50, the punch tool 12 or tools will produce the desired border pattern 16. After template 50 is selected, the corresponding punch tool 12 is placed within template slot 24, as illustrated in FIG. 5. It should be noted that templates 50 may relate to a particular border pattern 16 which may use more than a single style of punch tool 12. In normal use the user would choose template 50 based on the border pattern 16 they want to create, and then insert punch tool 12 or punches 12 as required by template 50.

Figure 3:
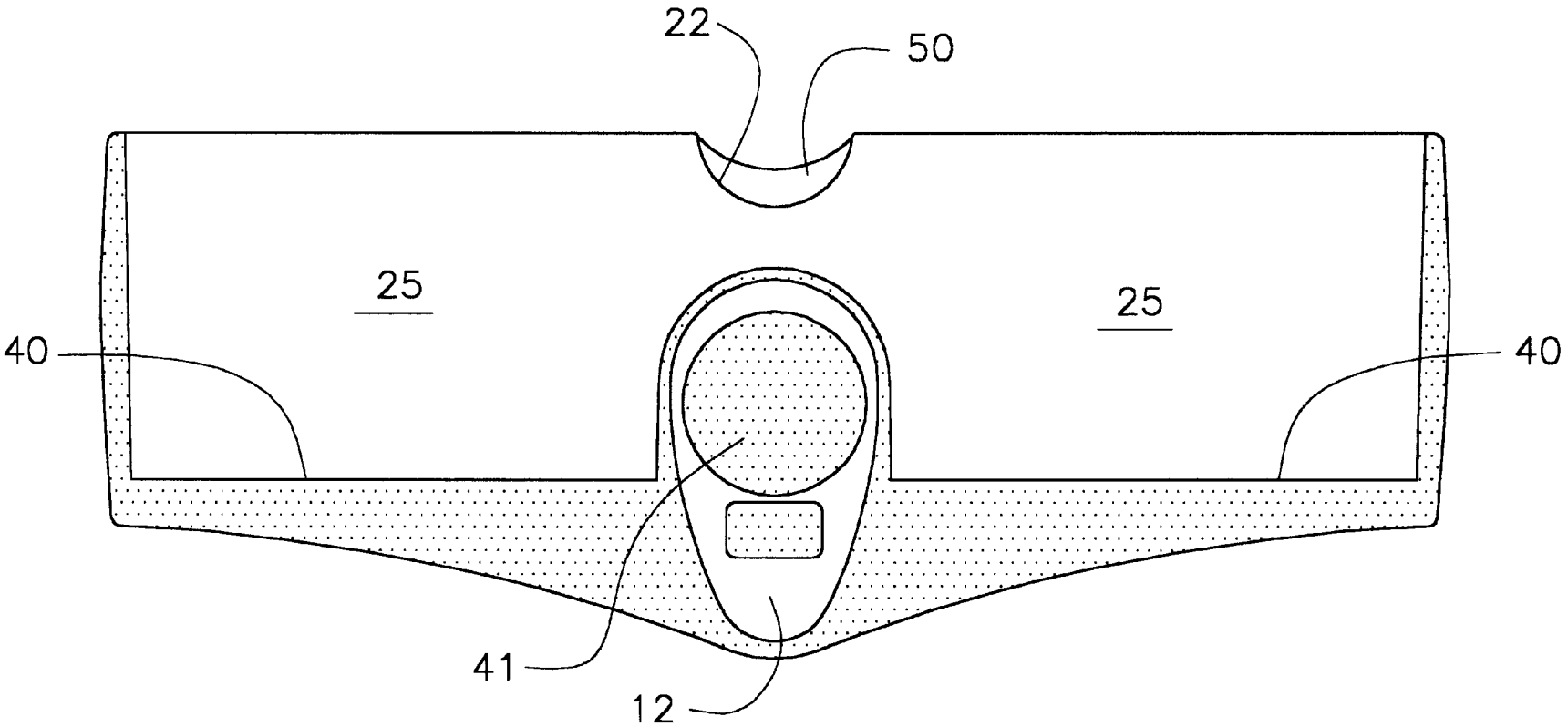
FIG. 3 illustrates a top view of an alignment device, in accordance with another embodiment of the present invention.

In one embodiment of the present invention, as illustrated in FIGS. 1 and 3, base 20 and transparent top piece 22 have an indent area 32 which is configured to provide a means to access and either remove or insert template 50 into or out of template slot 24.

It should be noted that although template 50 discussed herein is described as a separate entity from base 20 and template slot 24, this is intended only as one example configuration and is in no way intended to limit the scope of the present invention. For example, the features of template 50, discussed below, could be printed directly onto transparent top piece 22 such that transparent top piece 22/sheet media receiving area 25 will also constitute template 50, or the transparent top piece 22 could be eliminated and the indicia applied directly to the top surface of the base 20, sheet media receiving area 25. However, for the purposes of illustration, template 50 will be discussed as a separate piece from base 20/transparent top piece 22.

In one embodiment of the present invention, as illustrated in FIG. 4, sheet media alignment line indicia 51 are disposed perpendicular to longitudinal guide edge 40 and configured to align sheet media 14 such that sequential border designs 16 can made at accurately placed distances along the border of sheet media 14. It should be noted that for some border designs 16 the alignment line indicia 51 may not be evenly spaced. However, for the purposes of illustration the alignment line indicia 51 will be evenly spaced in this description.

In one embodiment of the present invention, as illustrated in FIG. 4, design alignment marks 52 are disposed on template 50 and configured to provide a means for proper spacing of border designs 16 after the front edge of sheet media 14 moves beyond the end of base 20. Design alignment marks 52 are disposed on template 50 in positions substantially corresponding to sheet media alignment line indicia 51 and positioned such that punched border designs 16 in sheet media 14 will line up over design marks 52. Design alignment marks 52 may be representations of the shape of the punches that will be used for the borders, or may be generic marks for use with various punches.

In situations using large sheet media 14, sheet media 14 may extend beyond the last sheet media alignment line indicia 51. However, by that point in the punching process at least a one punch has already been made in sheet media 14. In this situation, design alignment marks 52 are used in conjunction with the already punched border designs 16 to align sheet media 14 so as to make further punched border designs 16.

In one embodiment of the present invention, as illustrated in FIG. 4, a graduated triangular indicia 53 is disposed on template 50 opposite of sheet media alignment line indicia 51 and is configured to indicate to the user that the last punch for that border edge is approaching. At the end of graduated triangular indicia 53, a last punch area 55 is disposed on template 50 configured to indicate to the user that the last border design 16 for that border of sheet media 14 has been punched and that the user must stop punching and rotate sheet media 14 so that the second third and fourth edges may be punched.

In one embodiment of the present invention, as illustrated in FIG. 4, gradations 60 are disposed on either side of the graduations within triangular indicia 53 and on either side of sheet media alignment line indicia 51, and are used to compensate for variations in punch positioning by the user when punching with design alignment marks 52 and for minor variations in sheet media 14 sizes. The gradations 60 comprise major vertical lines 61 and minor vertical lines 62. Major vertical lines 61 represent the optimal trailing edge positions for the final punch designs 16 positions along an edge of sheet media 14. Minor vertical lines 62 are centered about each major vertical line 61, and are used to determine the distance the trailing edge is from the optimal positions. Minor vertical lines 62 are reduced in span on each major vertical line 61 closer to the final punch position. The user notes the position of the trailing edge on minor vertical lines 62 relative to first major vertical line 61. The trailing edge is then positioned to the same position relative to minor vertical lines 62 for subsequent punch positions bringing sheet media 14 accurately to its final position with small adjustments which would otherwise be imperceptible.

Figure 7:
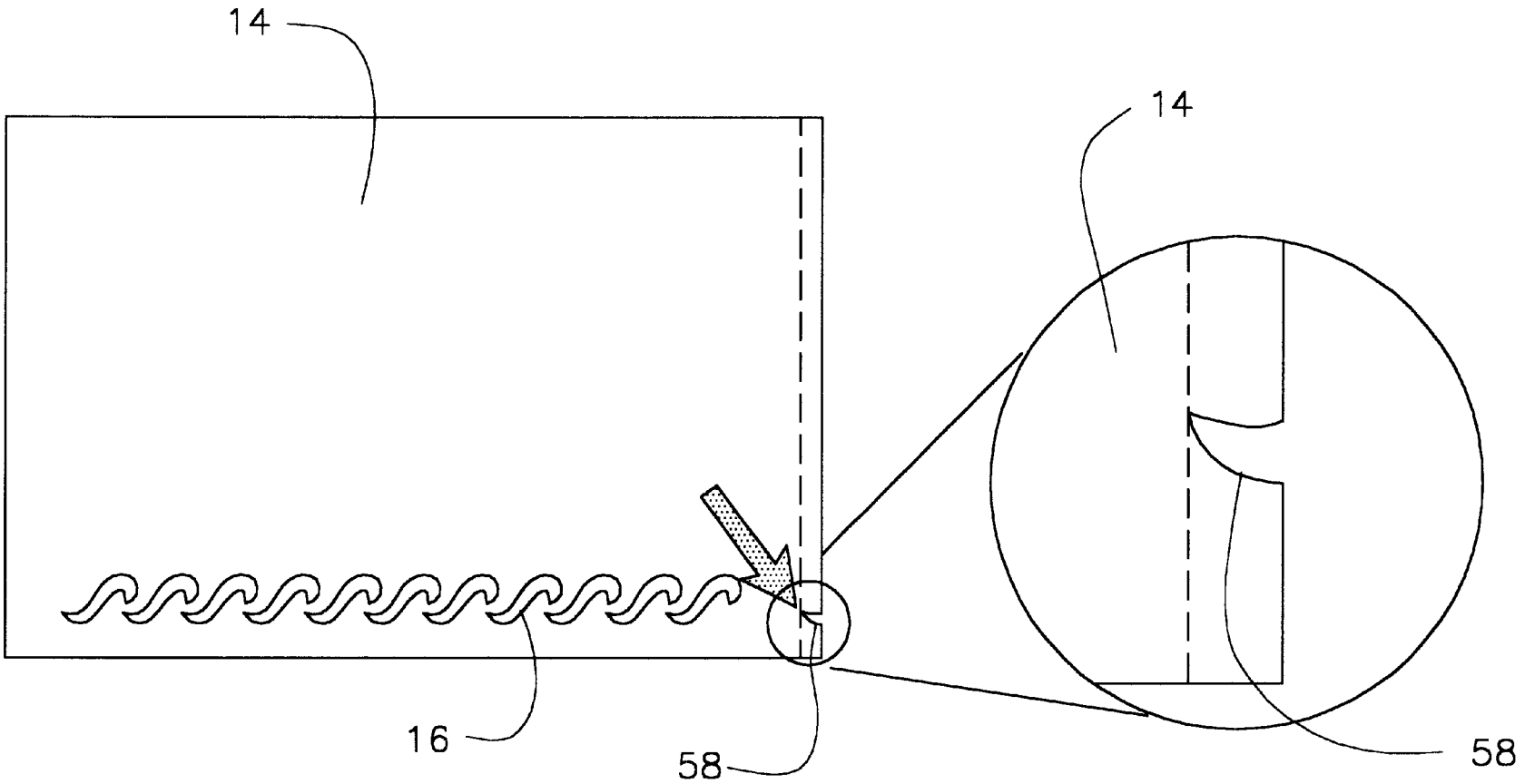
FIG. 7 illustrates a top view of a sheet media with a trimming guide punch mark and the corresponding trimming line position, in accordance with one embodiment of the present invention.

In one embodiment of the present invention, as illustrated in FIG. 4, an alternative means to address irregularly shaped sheet media 14 utilizes a trimming guide design indicia 54 differentiated by color or other means is disposed on template 50 and is configured to assist the user in trimming sheet media 14 such that border designs 16 can be dispensed about the entire border evenly and so border patterns 16 properly meet in the corners of sheet media 14. Because the punch design of punch tool 12 may not be exactly proportional to the length of the particular sheet media 14 that has been selected by the user, it is necessary in some cases to trim two of the four edges of sheet media 14. The trimming guide design indica 54 is disposed on template 50 in such a position that when the last border design 16 for a particular side of sheet media 14 is placed over matching trimming guide design 54 and punch tool 12 is punched. As illustrated in FIG. 7, trimming guide 58 is punched on or near the end of sheet media 14 which indicates the amount of sheet media 14 that needs to be trimmed from that edge in order for border design 16 to be equally spaced around all of the borders. Trimming guide 58 may be a partial punch design or full punch design 16 depending on where the edge of sheet media 14 falls relative to border pattern 16.

When set up, as illustrated in FIG. 5, the user selects a border pattern and the corresponding template 50 is placed in template slot 24 such that the indicia on template 50 are visible to the user through transparent top piece 22. Punch tool 12 or first punch tool 12 if more than one punch tool 12 is called for by the selected border pattern 16 or other device is placed in punch receiving area 28 of base 20. A sheet media 14 is selected and placed on sheet media receiving area 25 and along longitudinal guide edge 40. The leading edge of sheet media 14 is placed against a first alignment line indicia 51 and first border design 16 is punched.

Figure 6:
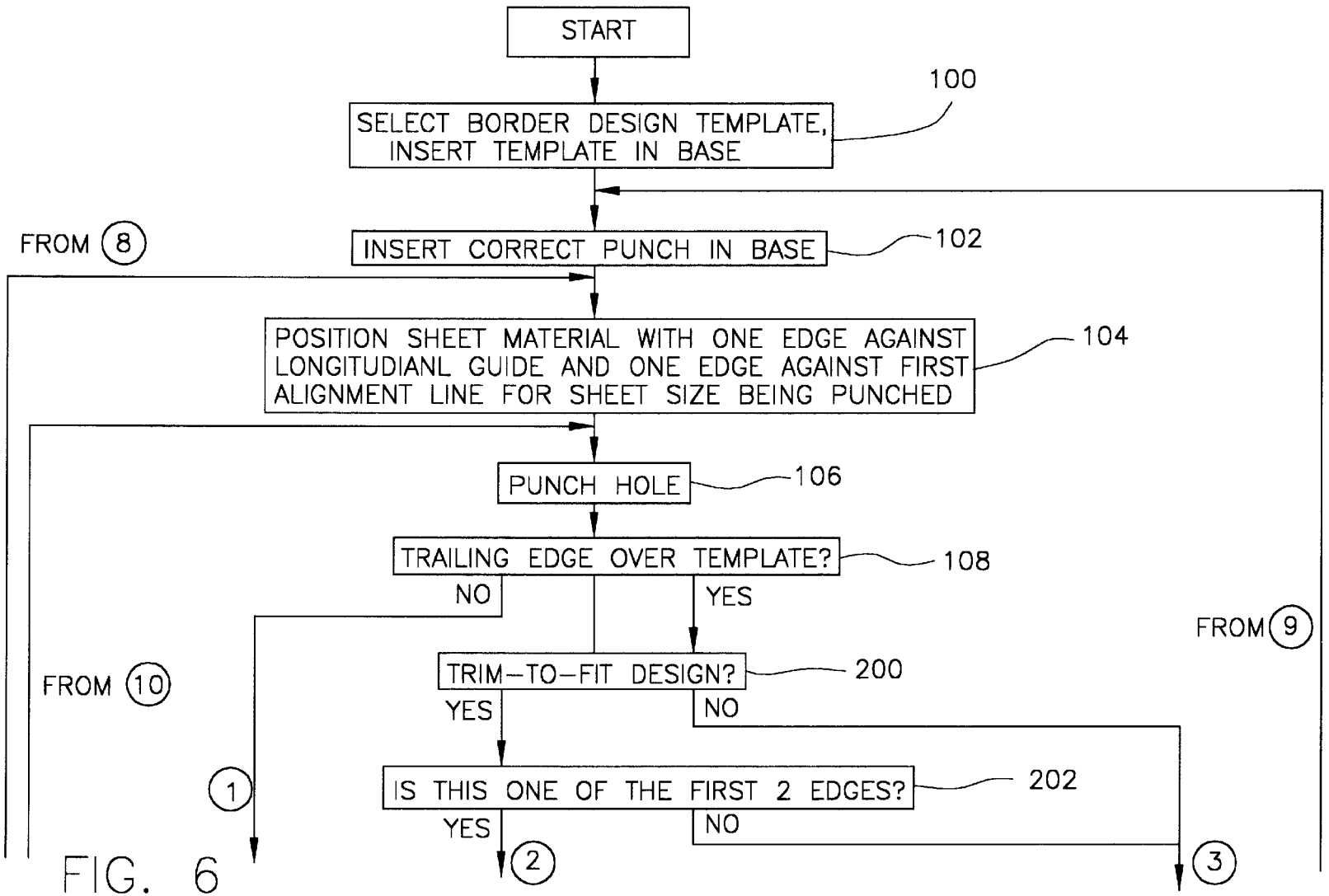
FIG. 6 illustrates a flow chart of the operation of an alignment device, in accordance with one embodiment of the present invention.
Figure 6A:
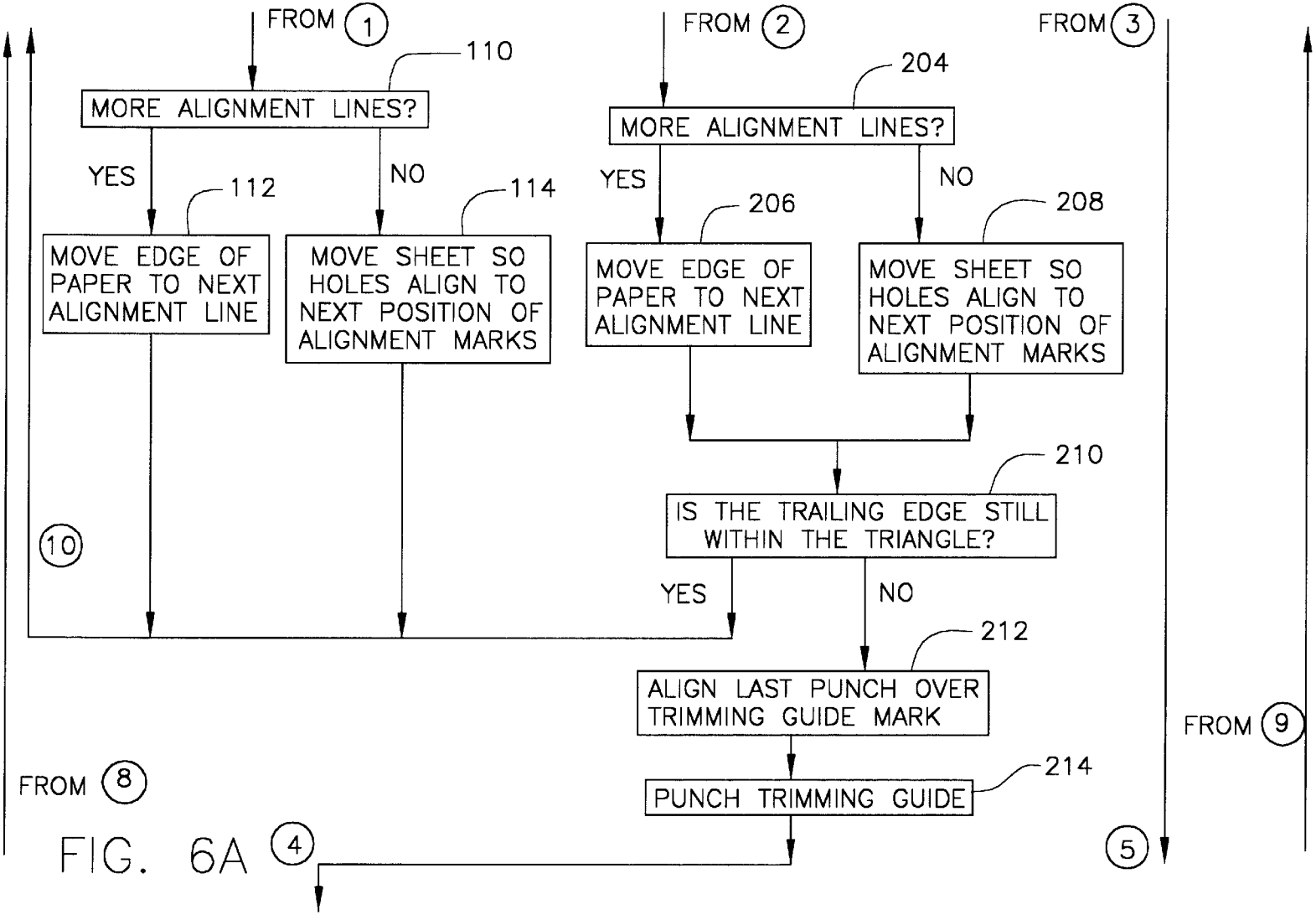
Figure 6B:
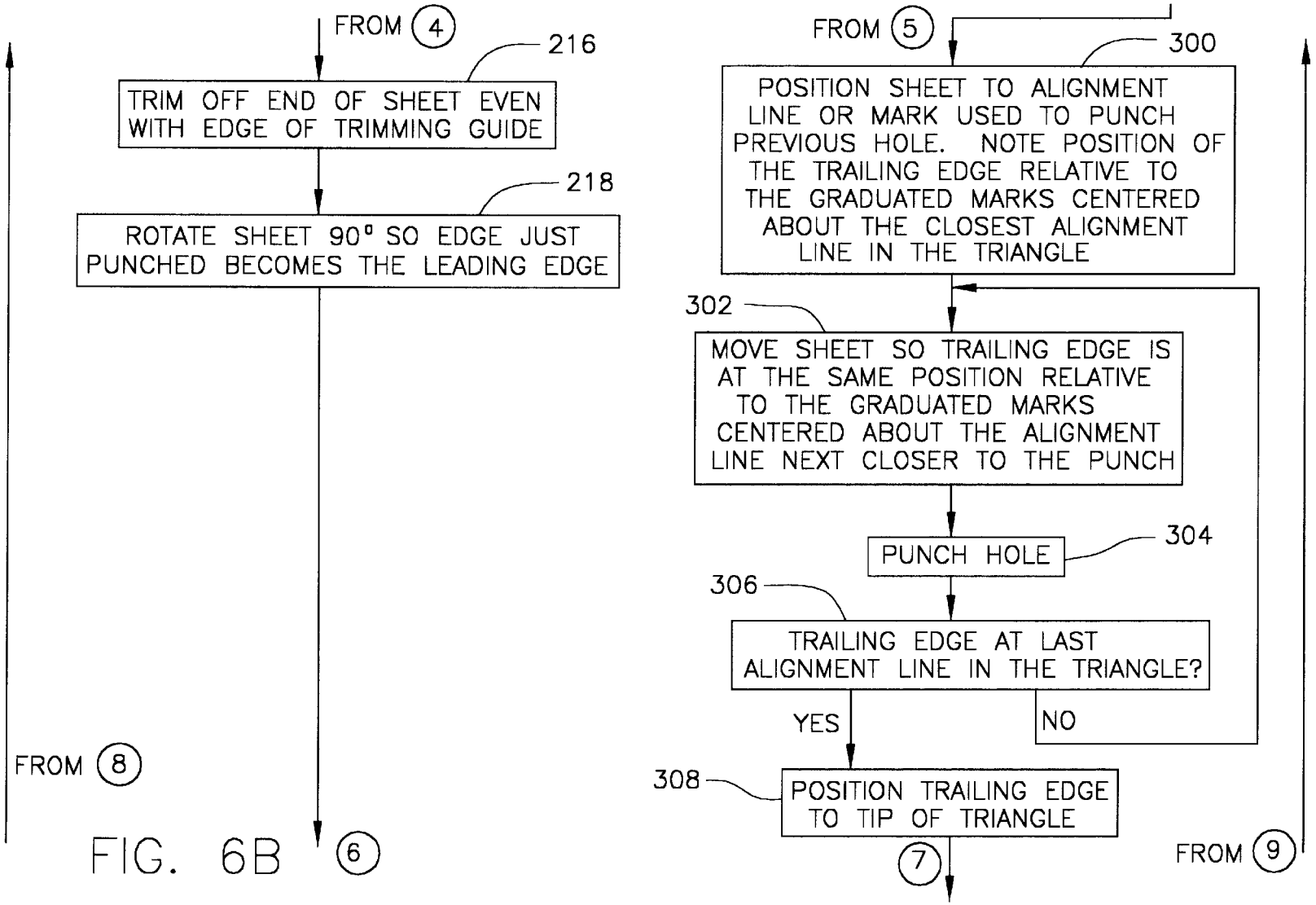
Figure 6C:
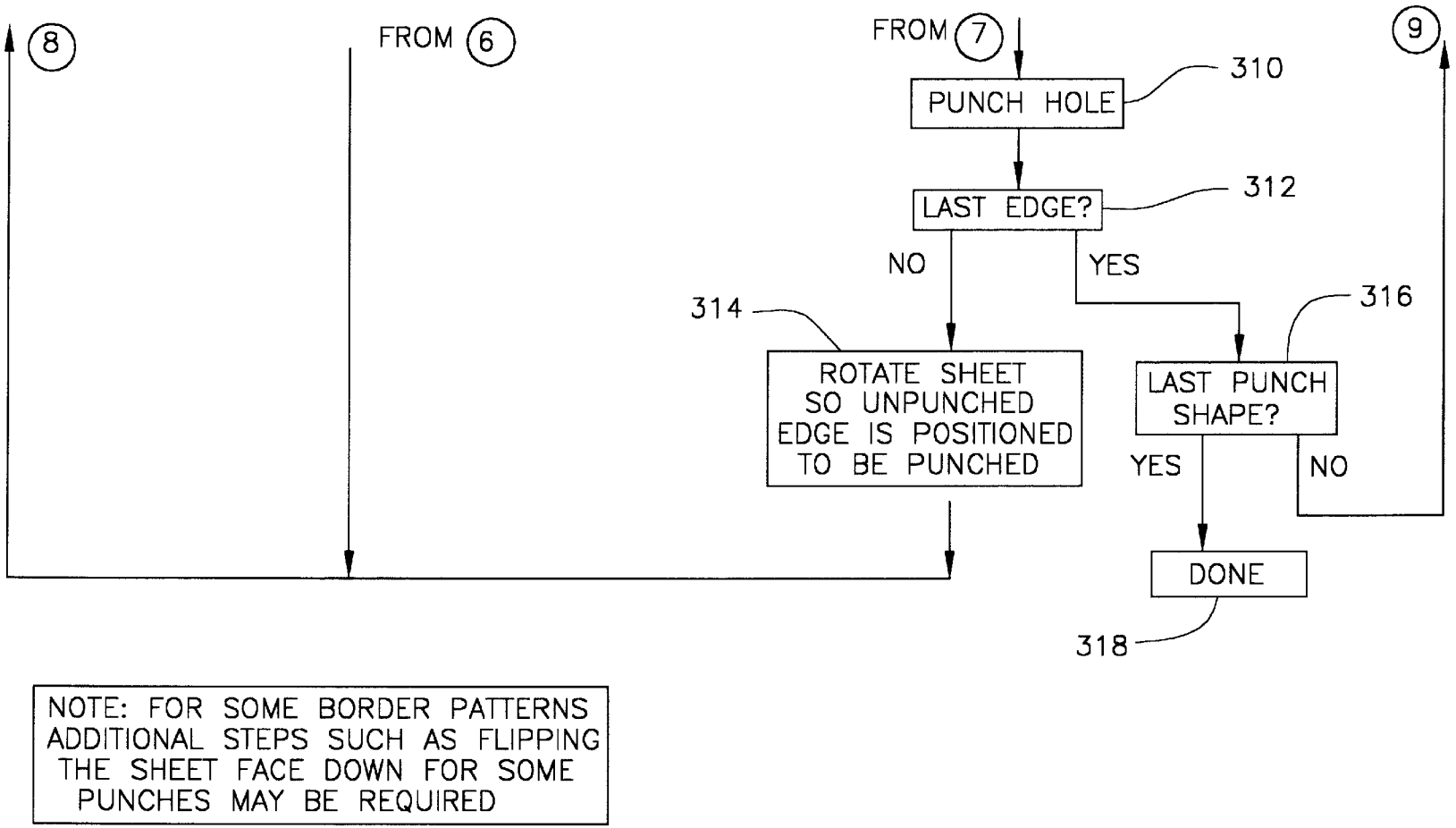

In operation, as illustrated in flow chart FIG. 6, at step 100, after the user selects a border design 16 and accompanying template 50, template 50 is placed in template slot 24. Next, at step 102, the accompanying punch tool 12 is placed into punch receiving area 28 of base 20.

At step 104, sheet media 14 is placed on sheet media receiving area 25, and against longitudinal guide edge 40. The front edge of sheet media 14, is positioned along the first alignment line indicia 51. At step 106, the user punches a first design 16 into sheet media 14 using punch tool 12.

Next, at step 108, the user determines if the trailing edge of sheet media 14 is over template 50. If yes, the user proceeds to subroutine 200. If not, the user proceeds to step 110. At step 110, the user determines if there are any more alignment line indicia 51 on template 50 for sheet media 14 to be aligned against. If yes, at step 112, sheet media 14 is advanced to the next sequential alignment line indicia 51. If not, at step 114, sheet media 14 is advanced along template 50 such that the already punched designs 16 are lined up to the next punch position using design alignment marks 52. After sheet media 14 is advanced along to the next position in either step 112 or 114 the user returns to step 106.

Regrading subroutine 200, if at step 108 the user determines that the trailing edge of sheet media 14 is over template 50, at step 200, the user determines if sheet media 14 needs to be trimmed to fit punch design 16 such that the punched designs 16 will meet evenly in all four corners of the borders of sheet media 14. If not, the user proceeds to subroutine 300. If yes, the user proceeds to step 202, where the user determines if it is one of the first two edges of sheet media 14. If not, the user proceeds to subroutine 300. If yes, at step 204, the user determines if there are more alignment line indicia 51 on template 50. If there are more alignment line indicia 51, at step 206 sheet media 14 is moved to the next sequential alignment line indica 51. Alternatively, if there are no more alignment line indicia 51 on template 50, at step 208, sheet media 14 is advanced along template 50 such that the already punched designs 16 are lined up to the next punch position using design alignment marks 52.

Next, at step 210, after sheet media has been aligned in either step 206 or 208, the user determines if the trailing edge of sheet media 14 is still within graduated triangular indicia 53. If yes, then the user returns to step 106. If not, then at step 212, the last punch design 16 is aligned over trimming guide design indicia 54. At step 214, trimming guide 58 is punched into sheet media 14. As described above, and as illustrated in FIG. 7, trimming guide 58 may consist of an entire design 16 or a partial design 16 (as pictured).

Next, at step 216, the users trims the edge of sheet media 14 along a projected line which runs parallel to the trailing edge at distance from that edge based on the inner most point reached by trimming guide 58, as pictured in FIG. 7. At step 218, the user rotates sheet media 14 90 degrees and returns to step 104.

Regarding subroutine 300, as illustrated in flow chart FIG. 6, the user, at step 300, positions sheet media 14 to the next sequential alignment line indicia 51 or design alignment mark 52. If necessary, the trailing edge of sheet media 14 is measured against gradations 60 in graduated triangular indicia 53 on template 50.

Next, at step 302, sheet media 14 is advanced such that the trailing edge is at the same position relative to gradation 60 centered about the next alignment line indicia 51 closer to punch tool 12. At step 304, the user punches a design 16. At step 306, the user determines if the trailing edge of sheet media 14 is at the last alignment line indicia 51 of graduated triangular indicia 53. If not, the user returns to step 302. If yes, then at step 308, the user positions the trailing edge of sheet media 14 to the tip of graduated triangular indicia 53. At step 310, the last punched design 16 is punched for that particular edge of sheet media 14.

Next, at step 312, the user determines if this was the last edge of sheet media 14 to be punched. If not, at step 314, sheet media 14 is rotated 90 degrees and then user proceeds to step 104. If this, was the last edge, then, at step 316, the user examines sheet media 14 to determine if this was the last punch design 16 to be used for this border. If not, the user returns to step 102 and selects a new punch tool 12 having a different shaped design 16 and the user proceeds to add a second border design 16 to the border of sheet media 14. If this was the last shape to be used then at step 318, the process is completed.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An alignment device for perforating a sheet media with a punch, said alignment device comprising:

a base member having a punch receiving area, an indicia receiving area, a sheet media receiving area and a longitudinal guide edge for aligning the sheet media wherein said punch tool receiving area is disposed along said longitudinal guide edge and further comprises a punch receiving cut out; and a template having a plurality of alignment indicia, said template insertable in said indicia receiving area of said base member, so that when said sheet media is placed along said longitudinal guide edge and aligned with the first of said alignment indicia, the punch is aligned to punch a first hole wherein said sheet media is moved to the second alignment indicia, said punch is aligned to punch a second hole.

2. The alignment device as claimed in claim 1, wherein said punch receiving area is recessed relative to said longitudinal guide edge so that punch cutting area of the punch tool protrudes into said sheet media receiving area.

3. The alignment device as claimed in claim 1, wherein said alignment indicia include alignment line indicia disposed perpendicular to said longitudinal guide.

4. The alignment device as claimed in claim 1, wherein said template further comprises gradations configured to compensate for variations in punch positions and irregular sheet media sizes.

5. The alignment device as claimed in claim 4, wherein said gradations are comprised of major vertical line and minor vertical lines.

6. The alignment device as claimed in claim 4, wherein said gradations are disposed on either side of said alignment indicia of said template.

7. An alignment device for perforating a sheet media with a punch, said alignment device comprising:

a base member having a punch receiving area, a sheet media receiving area and a longitudinal guide edge for aligning the sheet media; and a template having a plurality of alignment indicia including alignment line indicia disposed perpendicular to said longitudinal guide edge and design alignment marks corresponding to said alignment line indicia, wherein said design alignment marks match up with the punches in said sheet media, said template disposed on said sheet media receiving area, so that when said sheet media is placed along said longitudinal guide edge and aligned with the first of said alignment indicia, the punch is aligned to punch a first hole wherein said sheet material is moved to the second spaced indicia, said punch is aligned to punch a second hole.

8. The alignment device as claimed in claim 7, wherein said base member further comprises a punch tool receiving area disposed along said longitudinal guide edge.

9. An alignment device for perforating a sheet media with a punch, said alignment device comprising:

a base member having a punch receiving area, an indicia receiving area, a transparent sheet media receiving area and a longitudinal guide edge for aligning the sheet media; and a template having a plurality of alignment indicia including alignment line indicia disposed perpendicular to said longitudinal guide edge and design alignment marks corresponding to said alignment line indicia, wherein said design alignment marks match up with the punches in said sheet media, said template insertable in said indicia area of said base portion and under said transparent sheet receiving area, so that when said sheet media is placed along said longitudinal guide edge and aligned with the first of said alignment indicia viewable through said transparent sheet media receiving area, the punch is aligned to punch a first hole wherein said sheet material is moved to the second spaced indicia, said punch is aligned to punch a second hole.

10. The alignment device as claimed in claim 9, wherein said base member further comprises a punch tool receiving area disposed along said longitudinal guide edge.

11. The alignment device as claimed in claim 10, wherein said punch receiving area is recessed relative to said longitudinal so that punch cutting area of the punch tool protrudes into said sheet media receiving area.

12. An alignment device for perforating a sheet media with a punch, said alignment device comprising:

a base member having a punch receiving area, an indicia receiving area having a template slot having a transparent top piece, a sheet media receiving area and a longitudinal guide edge for aligning the sheet media; and a template having a plurality of alignment indicia, said template insertable in said indicia receiving area of said base portion, so that when said sheet media is placed along said longitudinal guide edge and aligned with the first of said alignment indicia, the punch is aligned to punch a first hole wherein said sheet media is moved to the second alignment indicia, said punch is aligned to punch a second hole.

13. The alignment device as claimed in claim 12, where in said template is placed in said template slot underneath said transparent top piece.

14. An alignment device for perforating a sheet media with a punch, said alignment device comprising:

a base member having a punch receiving area, an indicia receiving area, a sheet media receiving area and a longitudinal guide edge for aligning the sheet media; and a template having a plurality of alignment indicia wherein said alignment indicia includes alignment line indicia disposed perpendicular to said longitudinal guide edge and design alignment marks corresponding to the alignment line indicia, wherein said design alignment marks match up with the punches in said sheet media, said template insertable in said indicia receiving area of said base portion, so that when said sheet media is placed along said longitudinal guide edge and aligned with the first of said alignment indicia, the punch is aligned to punch a first hole wherein said sheet media is moved to the second alignment indicia, said punch is aligned to punch a second hole.

15. An alignment device for perforating a sheet media with a punch, said alignment device comprising:

a base member having a punch receiving area, an indicia receiving area, a sheet media receiving area and a longitudinal guide edge for aligning the sheet media; and a template having a plurality of alignment indicia including a graduated triangular indicia configured to provide a user with notification that the end of the edge of said sheet media is being approached, said template insertable in said indicia receiving area of said base portion, so that when said sheet media is placed along said longitudinal guide edge and aligned with the first of said alignment indicia, the punch is aligned to punch a first hole wherein said sheet media is moved to the second alignment indicia, said punch is aligned to punch a second hole.

16. An alignment device for perforating a sheet media with a punch, said alignment device comprising:

a base member having a punch receiving area, an indicia receiving area, a sheet media receiving area and a longitudinal guide edge for aligning the sheet media; and a template having a plurality of alignment indicia including a last punch region configured to indicate that the last punch on a given edge has been made, said template insertable in said indicia receiving area of said base portion, so that when said sheet media is placed along said longitudinal guide edge and aligned with the first of said alignment indicia, the punch is aligned to punch a first hole wherein said sheet media is moved to the second alignment indicia, said punch is aligned to punch a second hole.

17. An alignment device for perforating a sheet media with a punch, said alignment device comprising:

a base member having a punch receiving area, an indicia receiving area, a sheet media receiving area and a longitudinal guide edge for aligning the sheet media; and a template having a plurality of alignment indicia including a trimming guide design indicia configured to align said sheet media within said punch tool such that the next punch will create a trimming guide that indicates to a user a cut off position such that the border created on said sheet media will be properly spaced relative to the end of the border, said template insertable in said indicia receiving area of said base portion, so that when said sheet media is placed along said longitudinal guide edge and aligned with the first of said alignment indicia, the punch is aligned to punch a first hole wherein said sheet media is moved to the second alignment indicia, said punch is aligned to punch a second hole.

* * * * *